United States Patent [19]

Frins

[11] Patent Number: 5,013,030

[45] Date of Patent: May 7, 1991

[54] EXERCISE DEVICE

[76] Inventor: John J. Frins, 8 E. Clark Pl., South Orange, N.J. 07079

[21] Appl. No.: 552,913

[22] Filed: Jul. 16, 1990

Related U.S. Application Data

[63] Continuation-in-part of Ser. No. 375,975, Jul. 6, 1989, abandoned.

[51] Int. Cl.[5] ..... A63B 23/16; A63B 21/02

[52] U.S. Cl. ..... 272/67; 272/68

[58] Field of Search ..... 272/67, 68

[56] References Cited

U.S. PATENT DOCUMENTS

| | | | |
|---|---|---|---|
| 2,271,164 | 10/1941 | Sullivan | 272/68 |
| 3,612,521 | 10/1971 | Wendeborn | 272/67 |
| 4,033,580 | 7/1977 | Paris | 272/72 |
| 4,730,827 | 3/1988 | Williams | 272/67 |
| 4,750,734 | 6/1988 | Greenfield | 272/67 |
| 4,754,936 | 7/1988 | Dowd | 272/67 |

FOREIGN PATENT DOCUMENTS

| | | | |
|---|---|---|---|
| 568609 | 4/1945 | United Kingdom | 272/67 |

*Primary Examiner*—Richard J. Apley
*Assistant Examiner*—Jerome Donnelly
*Attorney, Agent, or Firm*—Bernard J. Murphy

[57] ABSTRACT

The Device is a circular body which takes the form of a disc. It has a first plurality of apertures formed therein in which to receive the little, ring, middle and index fingers of a hand. Spaced apart from the first plurality of apertures is a second plurality of apertures in which to receive the thumb of the hand. By disposing the thumb, randomly, in different apertures of the second plurality thereof, with the other fingers in the apertures of the first plurality thereof, and straining to squeeze all the fingers and thumb, forcefully, toward the center of the body, the muscle which joins the thumb to the hand gets especially exercised. The Device is non-handed; it is usable with either a left hand or a right hand.

7 Claims, 1 Drawing Sheet

EXERCISE DEVICE

This is a continuation-in-part application based on prior patent application Ser. No. 07/375,975, filed on July 6, 1989 abandoned.

This invention pertains to manual exercise devices, and in particular to such exercise devices especially configured to exercise, and thereby strengthen, the hand.

Hand exercise devices, known in the prior art, take the form of a powerful, helical spring, having handles at opposite ends, set at an acute angle, which are drawn together, against the bias of the spring, or of an elastomeric body, having recesses for the little, ring, middle and index fingers, which is squeezed.

Such prior art devices are reasonably acceptable for exercising and strengthening the aforesaid four fingers of the hand. However, they do little to exercise and strengthen the thumb. In working with such devices, the thumb plays a largely passive role. What has been needed is a device which will especially exercise and strengthen the thumb by particularly working the mxuscle which joins the thumb to the hand.

It is an object of this invention to set forth just such a long needed device.

It is particularly an object of this invention to set forth an exercise device comprising a circular body; wherein said body comprises a disc; said body has a diameter which defines equal halves of said disc; said body further has a first plurality of apertures formed in only one of said halves of said disc for receiving therein the four, substantially juxtaposed fingers of a hand, that is, the little, ring, middle and index fingers; and said body also has a second plurality of apertures formed in only the other half of said disc for receiving therein the thumb of a hand; wherein said disc encompasses a given area; the areal sum of all of said apertures is substantially less than half of said given area; said apertures of said first plurality thereof are smaller than said apertures of said second plurality thereof, to distinguish, keyingly, between finger apertures and thumb apertures; said apertures of said first plurality thereof each have a common diametral dimension; all apertures of said second plurality thereof are spaced apart from a most proximate one of said apertures of said first plurality at least twice said diametral dimension; and said disc has a thickness of approximately three quarters of an inch.

Figure 1:
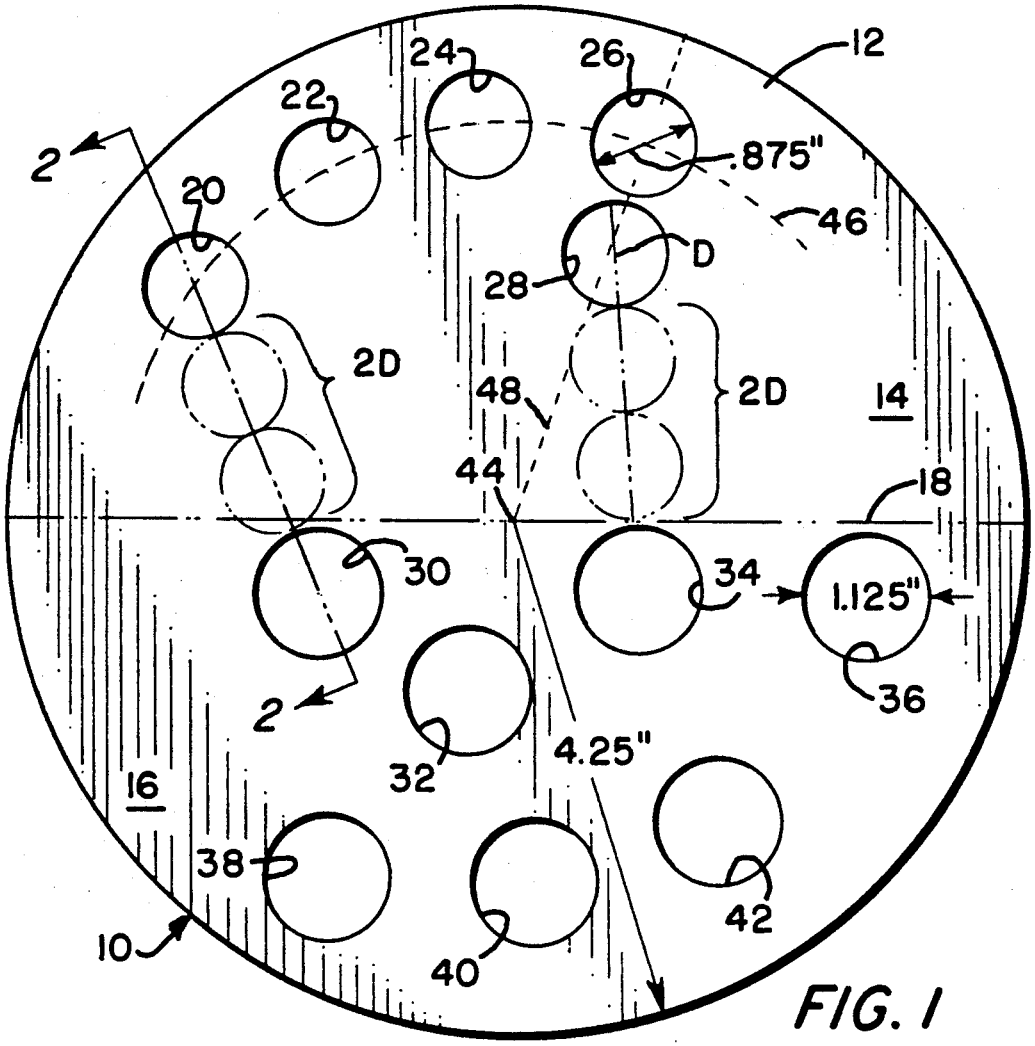
Figure 2:
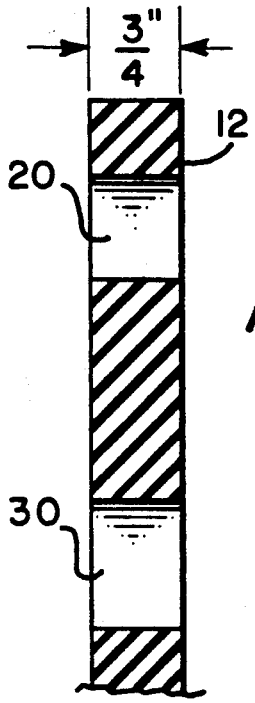

Further objects of this invention, as well as the novel features thereof, will become more apparent by reference to the following description taken in conjunction with the accompanying figures, in which:

FIG. 1 is a plan view of an exercise device according to an embodiment of the invention; and FIG. 2 is a partial cross sectional view, of the embodiment of FIG. 1, the same taken along section 2—2 of FIG. 1.

As shown in the figures, the device 10, according to an embodiment thereof, comprises a circular body 12 which takes the form of a disc. The body 12 has first and second portions 14 and 16, respectively, defined by an imaginary, diametral line 18 drawn across the body 12. Apertures 20, 22 24, 26 and 28 are formed through the body 12 in only the first portion 14 thereof. Apertures 30, 32, 34 and 35, comprising a first group, and apertures 38, 40, and 42, comprising a second group thereof, are formed through the body 12 in only the second portion 16 thereof.

The aforesaid apertures in the first portion 14 are provided to receive the little, ring, middle and index fingers of a hand. With reference to FIG. 1, it will be appreciated that apertures 26 and 28 are usable, alternatively, by the index finger of a left hand, or the little finger of a right hand. Ihe aforesaid apertures in the second portion 16 of the body 12 are provided to receive the thumb of a left hand or right hand; the thumb, of course, may be disposed in any of the seven apertures.

As noted earlier, the novel device 10 is especially configured to exercise and strengthen the muscle of the thumb. To this end, the aforesaid seven thumb apertures (30, 32, 34, 36, 38, 40 and 42) are widely scattered in their half portion 16 of the body 12. Diligent exercised use of each of the seven thumb apertures will properly work the thumb muscle. Also, the latter, enumerated, seven thumb apertures are adequately distanced from the finger apertures 20, 22, 24, 26, and 28, again to insure optimum thumb muscle exercise. The latter finger apertures are of one, common diameter, seven-eighths of an inch (0.8750″), whereas the thumbapertures 30, 32, 34, 36, 38, 40 and 42, are of another, common diameter, one and one eighth inch (1.1250″). The latter apertures are larger than the former apertures to distinguish, keyingly in this way, the finger apertures from the thumb apertures. Too, thumb apertures warrant being larger. As explained, the thumb apertures are adequately distanced from the finger apertures, to require a minimum thumb extension which will offer adequate working of the thumb muscle. In FIG. 1, the common diametral measure of the finger apertures is denoted "D". It can be seen that all of the thumb apertures are spaced apart from the finger apertures at least twice that diametral measure, i.e., "2D".

The body 12 has a center 44 and, in this embodiment of the invention, apertures 20, 22, 24 and 26 are sited along an arc 46 drawn from the center; this offers a greatest possible hand spread, when the thumb is being worked, alternatively, in the apertures 38, 40 and 42. Apertures 28 and 26 are sited along a radial line 48, drawn from the center 44, to afford a first nipping grasp between the thumb and the index finger of the left hand, with reference to the FIG. 1 disposition of the body 12, with the index finger in the aperture 26, and a tighter, closer, nipping grasp therebetween, with the index finger in the aperture 28.

In use, then, by way of example, one inserts the little, ring, middle and index fingers of a left hand in the apertures 20, 22, 24 and 26 or 28, respectively, of the first portion 14, and the thumb is inserted in one of the apertures in the second portion 16. Then, the hand is squeezed; i.e., all the fingers, and the thumb, are strained toward the center 44, generally, repeatedly. Then the thumb is placed in another of the apertures in the second portion, and the squeezing, straining exercise is repeated. All during the exercise regimen, the thumb is randomly inserted in the seven apertures provided therefore and, by this means, the muscle which joins it to the hand is especially exercised and strengthened.

The device 10, as shown in FIG. 1 is especially configured for the left hand, although the FIG. 1 disposition will accommodate the right hand as well. By simply turning the device 10 over, it is especially configured, then, for the right hand. Simply, the device is non-handed; it is usable for exercising either hand.

In FIG. 2, the body is shown cross hatched to represent rubber; in the preferred embodiment, the body is formed of hard rubber, and has a thickness of three quarters of an inch. However, the invention can be embodied in a plastic body, a wooden body, or any body of reasonably rigid composition.

The three-quarter-inch thickness of the body has a particular benefit. Ihe aforesaid thickness provides a comfortable land, in each of the apertures, for the second joints of the fingers and thumb. If the body 12 were to be fabricated of much thinner material, the same would tend to indent the second joints and cause discomfort thereat.

In the preferred embodiment, the body 12 has a diameter of eight and a half inches, hence, a radius of four and a quarter inches. The areal mass of the body 12, then, is substantially fifty-six and three-quarters square inches.

The areal sum of all the apertures is approximately ten square inches; i.e., less than half of the overall area of the body 12. Consequently, most of the body 12 is substance. Particularly, where the body is formed of rubber, it would weaken it too much if there were so great a plurality of apertures that the exercising therewith was effortless. It is for this reason that the body was designed to insure that most of it is substantial, to offer an appreciable resistance to the hand squeezing and straining.

While I have described my invention in connection with a specific embodiment thereof, it is to be clearly understood that this is done only by way of example, and not as a limitation to the scope of my invention, as set forth in the objects thereof and in the appended claims.

I claim:

1. An exercise device, comprising:

a circular body; wherein said body comprises a disc;

said body has a diameter which defines equal halves of said disc;

said body further has a first plurality of apertures formed in only one of said halves of said disc for receiving therein the four, substantially juxtaposed fingers of a hand, that is, the little, ring, middle and index fingers; and said body also has a second plurality of apertures formed in only the other half of said disc for receiving therein the thumb of a hand; wherein said disc encompasses a given area;

the areal sum of all of said apertures is substantially less than half of said given area;

said apertures of said first plurality thereof are smaller than said apertures of said second plurality thereof, to distinguish, keyingly, between finger apertures and thumb apertures;

said apertures of said first plurality thereof each have a common diametral dimension;

all apertures of said second plurality thereof are spaced apart from a most proximate one of said apertures of said first plurality at least twice said diametral dimension; and said disc has a thickness of approximately three-quarters of an inch.

2. An exercise device, according to claim 1, wherein:

said second plurality of apertures comprises groups of apertures; and one of said groups is more proximate to said first plurality of apertures than is another of said groups.

3. An exercise device, according to claim 1, wherein:

said body has a radial center; and apertures of said first plurality thereof are sited along a given radial arc drawn from said center.

4. An exercise device, according to claim 1, wherein:

said body has a radial center; and apertures of said first plurality thereof are sited along a given radial line drawn from said center.

5. An exercise device, according to claim 1, wherein:

said second plurality of apertures comprises at least four apertures.

6. An exercise device, according to claim 1, wherein:

said second plurality of apertures comprises seven apertures.

7. An exercise device, according to claim 1, wherein:

said body is formed of hard rubber.

* * * * *